US006802129B1

(12) United States Patent
Wirth

(10) Patent No.: US 6,802,129 B1
(45) Date of Patent: Oct. 12, 2004

(54) ARCHERY SIGHT, AN OPTIC ASSEMBLY, AND OPTIC ADJUSTMENT MECHANISMS FOR USE IN AN ARCHERY SIGHT

(76) Inventor: Reinhold F. Wirth, 156 Middle Line Rd., Balston Spa, NY (US) 12020

( * ) Notice: Subject to any disclaimer, the term of this patent is extended or adjusted under 35 U.S.C. 154(b) by 4 days.

(21) Appl. No.: 10/236,544

(22) Filed: Sep. 6, 2002

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | | |
|---|---|---|---|---|---|
| 3,355,809 | A | | 12/1967 | Guyton | 33/46 |
| 3,579,839 | A | * | 5/1971 | Kowalski | 33/265 |
| 3,861,051 | A | | 1/1975 | Killian | 33/265 |
| 4,020,560 | A | * | 5/1977 | Heck | 33/265 |
| 4,309,827 | A | | 1/1982 | Larson | 33/265 |
| 4,449,303 | A | | 5/1984 | Larson | 33/265 |
| 4,521,972 | A | | 6/1985 | Larson | 33/265 |
| 4,928,394 | A | | 5/1990 | Sherman | 33/265 |
| 4,977,677 | A | * | 12/1990 | Troescher, Jr. | 33/265 |
| 5,090,805 | A | | 2/1992 | Stawarz | 365/251 |
| 5,092,053 | A | | 3/1992 | Roberts | 33/265 |
| 5,094,002 | A | | 3/1992 | Saunders | 33/265 |
| 5,117,804 | A | * | 6/1992 | Jorlov | 124/87 |
| 5,168,631 | A | | 12/1992 | Sherman | 33/265 |
| 5,201,124 | A | | 4/1993 | Sherman | 33/265 |
| 5,231,765 | A | | 8/1993 | Sherman | 33/241 |
| 5,289,814 | A | * | 3/1994 | Maisano | 124/87 |
| 5,384,966 | A | | 1/1995 | Gibbs | 33/265 |
| 5,442,861 | A | | 8/1995 | Lorocco | 33/241 |
| 5,630,279 | A | * | 5/1997 | Slates | 33/265 |
| 5,649,526 | A | | 7/1997 | Ellig | 124/87 |
| 5,685,081 | A | | 11/1997 | Winegar | 33/265 |
| 5,862,603 | A | | 1/1999 | Ellig | 33/265 |
| 5,941,226 | A | | 8/1999 | Marietta | 124/87 |
| 5,996,569 | A | | 12/1999 | Wilson | 124/87 |
| 6,131,295 | A | | 10/2000 | Cranston | 33/265 |
| 6,401,347 | B1 | * | 6/2002 | Slates | 33/265 |
| 6,418,633 | B1 | * | 7/2002 | Rager | 33/265 |
| 6,430,822 | B1 | * | 8/2002 | Slates | 33/265 |
| 6,494,604 | B2 | * | 12/2002 | Khoshnood | 33/265 |
| 6,508,005 | B2 | * | 1/2003 | Springer | 33/265 |
| 6,560,884 | B1 | * | 5/2003 | Afshari | 33/265 |
| 6,564,462 | B1 | * | 5/2003 | Henry | 33/265 |
| 6,601,308 | B2 | * | 8/2003 | Khoshnood | 33/265 |
| 2001/0032393 | A1 | * | 10/2001 | Springer | 33/265 |
| 2002/0083602 | A1 | * | 7/2002 | Slates | 33/265 |
| 2003/0056379 | A1 | * | 3/2003 | Johnson et al. | 33/265 |
| 2003/0110647 | A1 | * | 6/2003 | Henry | 33/265 |

OTHER PUBLICATIONS

Copper John Corporation Website (www.copperjohn.com) "Dead Nuts Hunting Sight".

* cited by examiner

*Primary Examiner*—G. Bradley Bennett
(74) *Attorney, Agent, or Firm*—Heslin Rothenberg Farley & Mesiti P.C.; John Pietrangelo

(57) ABSTRACT

An archery sight and an optic assembly, an elevation adjustment mechanism, a windage adjustment mechanism, and a third-axis leveling mechanism for use in an archery sight. The optic assembly includes a lens holder having a housing made from a light-transferring material and an aperture; at least one fiber-optic pin positioned in the aperture; and means for illuminating the fiber-optic pin. The elevation adjustment mechanism includes a slider upon which an optic can be mounted and a rack and pinion mechanism for varying the elevation of the optic. The windage adjustment mechanism includes a slidably mounted windage bar adapted for mounting an optic and a means for translating the windage bar to adjust the windage of the optic. The third-axis leveling mechanism includes an adjustable leveling vial integrated with the optic house. A method and apparatus for leveling an archery bow and sight are also disclosed.

44 Claims, 5 Drawing Sheets

ARCHERY SIGHT, AN OPTIC ASSEMBLY, AND OPTIC ADJUSTMENT MECHANISMS FOR USE IN AN ARCHERY SIGHT

TECHNICAL FIELD

This invention relates generally to assemblies and mechanisms used for sights for aiming. Specifically, the present invention provides improved optic assemblies, elevation adjustment mechanisms, and windage adjustment mechanisms for archery sights.

BACKGROUND OF THE INVENTION

Historically, it is typically difficult for an archer to approach the accuracy achievable using a gun, for example, since shooting a bow proficiently requires many hours of practice to obtain the understanding of and insight into the dynamics of the flight of an arrow. For example, to many, shooting an arrow with a bow is considered an instinctive skill. Many prior art sights are available to increase the bowman's accuracy while facilitating the archer's use of a bow and arrow. Some of these prior art sights may include fiber optics to illuminate the sighting pin and some prior art sights may include some form of sight adjustments. These sight adjustments include elevation adjustments and horizontal adjustments to vary the sighting parameters depending upon prevailing conditions, for example, the distance to the target or the wind direction and speed, among other things. In the archery art, the horizontal adjustment is referred to as "windage adjustment, or simply", "windage". Another term of the archery art is "third-axis leveling". Third-axis leveling refers to the adjustment of the archery bow sight to ensure that the sight is level with the bow string regardless of the bow orientation, for example, regardless of the angular elevation of the bow.

However, many prior art constructions, including optic assemblies, elevation adjustment mechanisms, windage adjustment mechanisms, third-axis leveling mechanisms are prone to inaccuracies, damage, failure, or are simply difficult to manipulate or maintain at the desired settings. Furthermore, with the advent of compound archery bows and the typical speed of use and manipulation to which such bows are exposed, the limitations on structural integrity, accuracy, and ease of use of prior art archery sights are further taxed and as a result often perform unsatisfactorily. As a result there exists a need in the art for an improved archery sight, in particular, a need for an improved optic assembly, an improved elevation adjustment mechanism, an improved windage adjustment mechanism an improved third-axis leveling mechanism that overcome the limitations of the prior art archery sights.

SUMMARY OF THE INVENTION

Many of the limitations of the prior art are addressed by one or more aspects of the present invention. One aspect of the invention is an optic assembly for use in an archery sight, the optic assembly including a lens holder having a housing at least partially made from a light-transferring material; an aperture in the housing; means for mounting a lens in the aperture; and means for mounting the housing to the sight; and at least one fiber-optic pin positioned in the lens holder; wherein the housing made from the light-transferring material provides at least some illumination to the fiber-optic pin. In one aspect of the invention, the housing provides essentially all the illumination for the at least one fiber-optic pin. In another aspect of the invention, the optic assembly further includes an artificial light source for illuminating the at least one fiber-optic pin, for example, a light-emitting diode.

Another aspect of the invention is an elevation adjustment mechanism for an archery bow sight having an optic, the adjustment mechanism comprising: an elongated main body adapted for mounting to a bow, the main body having a channel elongated in the direction of elongation of the main body; a slider adapted for mounting to the optic and slidably engageable with the channel of the main body and having a rack thereon; a shaft mounted for rotation in the main body and having a pinion engageable with the rack of the slider; and means for rotating the shaft wherein the pinion engages the rack of the slider wherein elevation adjustment of the optic is provided. In one aspect of the invention, the elevation adjustment mechanism further includes means for retaining the elevation setting of the optic at the desired elevation, for example, at least one set screw mounted in the main body.

Another aspect of the invention is a windage adjustment mechanism for an archery bow sight having an optic, the adjustment mechanism comprising: a main body adapted for mounting to a bow and having a channel; a windage bar slidably mounted in the channel and adapted for mounting the optic to the windage bar; and means for translating the windage bar in the channel wherein windage adjustment of the optic is provided. In one aspect of the invention, the windage bar further comprises a recess and wherein the means for translating the windage bar comprises a threaded rod having a projection which engages the recess in the windage bar. In one aspect of the invention, the projection on the threaded rod comprises a disk mounted to the threaded bar, for example, a disk integrally mounted to the threaded bar.

A still further aspect of the invention is an elevation and windage adjustment mechanism for an archery bow sight having an optic, the adjustment mechanism comprising: an elongated main body adapted for mounting to a bow, the main body having a first channel elongated in the direction of elongation of the main body; a slider slidably engageable with the first channel of the main body, the slider having a rack thereon and a second channel elongated in a direction perpendicular to direction of elongation of the main body; a windage bar slidably mounted in the second channel of the slider and adapted for mounting the optic to the windage bar; a shaft mounted for rotation in the main body and having a pinion engageable with the rack of the slider mount; means for rotating the shaft wherein the pinion engages the rack of the slider wherein elevation adjustment of the optic is provided; and means for translating the windage bar in the second channel wherein windage adjustment of the optic is provided.

A even further aspect of the invention is an archery sight comprising: an optic assembly, the optic assembly comprising: a lens holder comprising: a housing made from a light-transferring material; an aperture in the housing; means for mounting a reticle in the aperture; and means for mounting the housing to the sight; and at least one fiber-optic pin positioned in the lens holder; wherein the housing made from the light-transferring material provides at least some illumination to the fiber-optic pin; an elevation adjustment mechanism comprising: an elongated main body adapted for mounting to a bow, the main body having a first channel elongated in the direction of elongation of the main body; a slider adapted for mounting to the optic assembly and slidably engageable with the first channel of the main body and having a rack thereon; a shaft mounted for rotation in the main body and having a pinion engageable with the rack of the slider; and means for rotating the shaft wherein the pinion engages the rack of the slider wherein elevation adjustment of the optic assembly is provided; and a windage adjustment mechanism comprising: a second channel in the slider of the elevation adjustment mechanism; a windage bar slidably mounted in the second channel and adapted for mounting to the optic assembly; and means for translating the windage bar in the second channel wherein windage adjustment of the optic assembly is provided.

A still further aspect of the invention is a third-axis leveling mechanism for an archery bow sight having an optic, the third-axis leveling mechanism comprising: a leveling vial mount adjustably mounted to the optic; a leveling vial mounted in the leveling vial mount; means for adjusting the position of the leveling vial mount to provide third-axis leveling of the archery bow. In one aspect of the invention, the means for adjusting the position of the leveling vial mount comprises at least one adjustment screw.

Another aspect of the invention is a method of leveling an archery bow having a bow string and a sight the sight having an optic and the optic having a housing, a vial level, and a vial level mount, the method comprising: mounting the archery bow in a first position; adjusting the archery bow to a second position wherein the bow string is substantially plumb; rotating the sight relative to the bow string wherein the vial level is substantially perpendicular to the bow string; rotating the archery bow at least about 5 degrees about a horizontal axis to a third position; and while the archery bow is in the third position, adjusting the position of the vial level mount relative to the optic housing wherein the vial level is substantially perpendicular to the bow string. In one aspect of the invention, the vial level mount further comprises at least one mounting screw, and the method further comprises, prior to adjusting the position of the vial level mount relative to the optic housing, loosening the at least one vial level mount mounting screw. In another aspect of the invention, the method further comprises, after adjusting the position of the vial level mount relative to the optic housing, tightening the at least one vial level mount mounting screw.

These and other embodiments and aspects of the present invention will become more apparent upon review of the attached drawings, description below, and attached claims.

BRIEF DESCRIPTION OF THE DRAWINGS

The subject matter which is regarded as the invention is particularly pointed out and distinctly claimed in the concluding portion of the specification. The present invention both as to organization and method of practice, together with advantages thereof, may best be understood by reference to the following detailed descriptions of some aspects of the invention and the accompanying drawings in which:

DETAILED DESCRIPTION OF THE PREFERRED EMBODIMENTS

Figure 1:
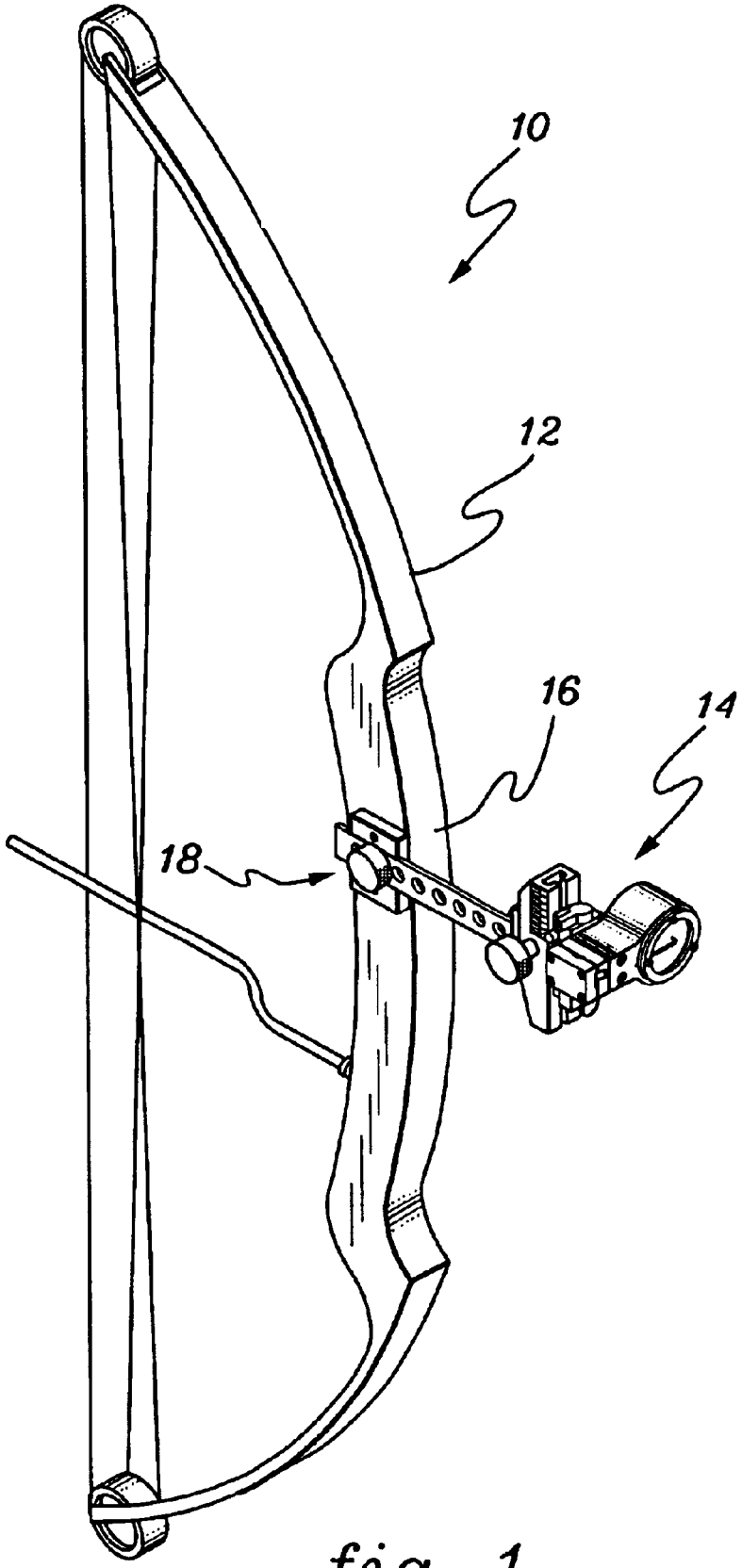
FIG. 1 is a perspective view of one aspect of the invention as mounted upon a bow.

FIG. 1 illustrates a perspective view of a bow and sight assembly 10 comprising a conventional archery bow 12 and a sight 14 according to one aspect of the present invention. Typically, sight 14 is mounted to a bow handle riser 16 of bow 12 by a mounting arrangement 18, which will be discussed in further detail with respect to FIG. 2.

Figure 2:
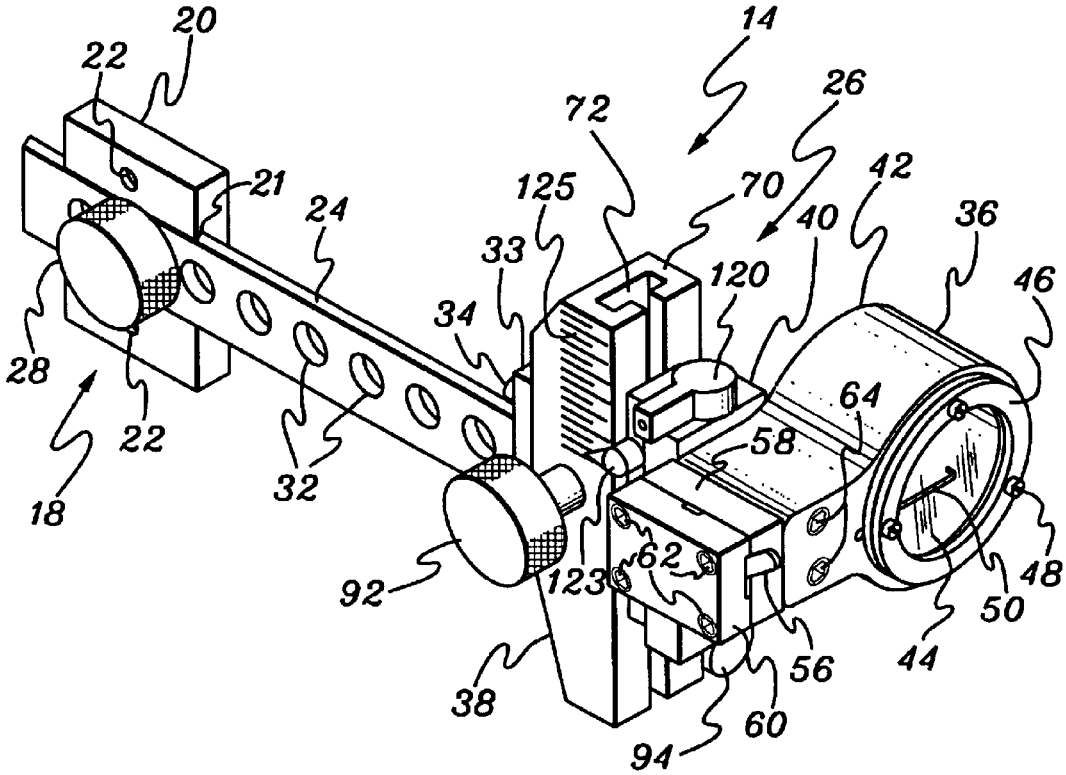
FIG. 2 is a perspective view of one aspect of the invention shown in FIG. 1.
Figure 3:
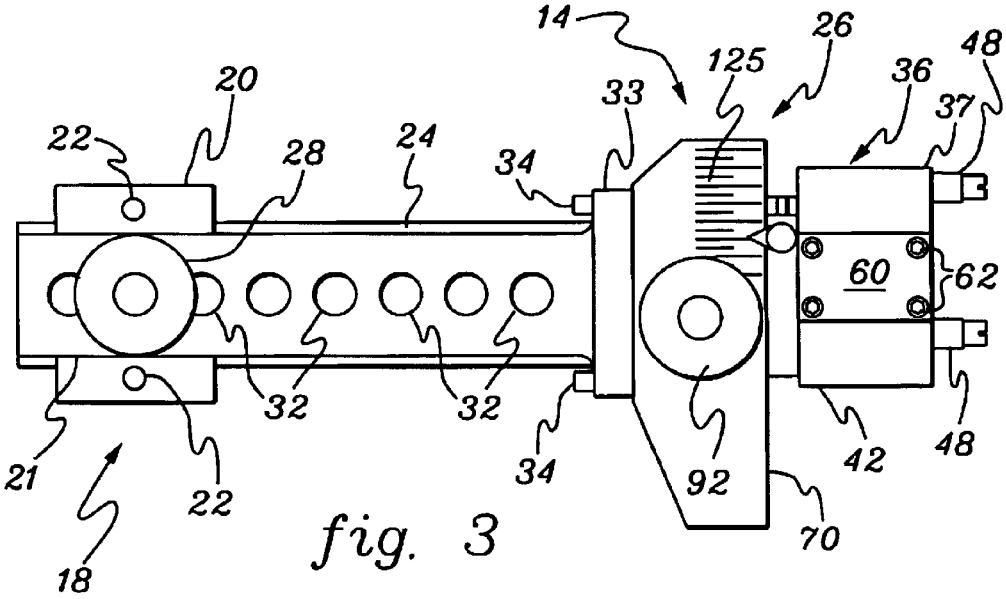
FIG. 3 is a side elevation view of the aspect of the invention shown in FIG. 2.
Figure 4:
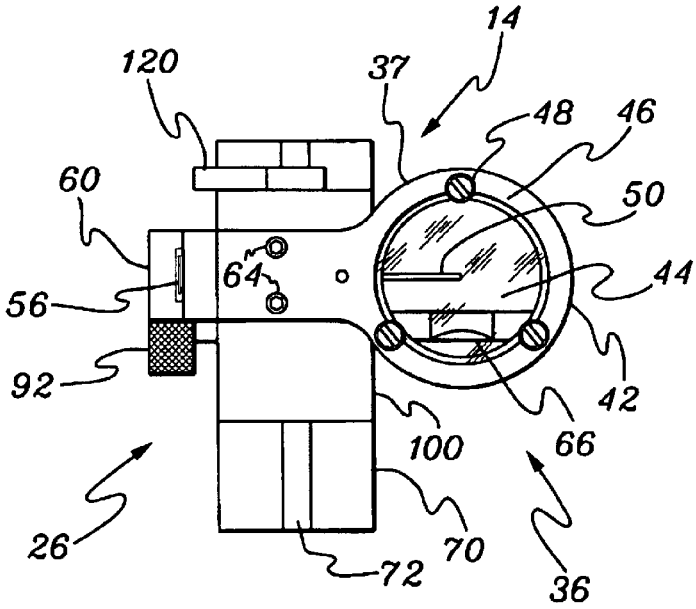
FIG. 4 is a front elevation view of the aspect of the invention shown in FIG. 2.
Figure 5:
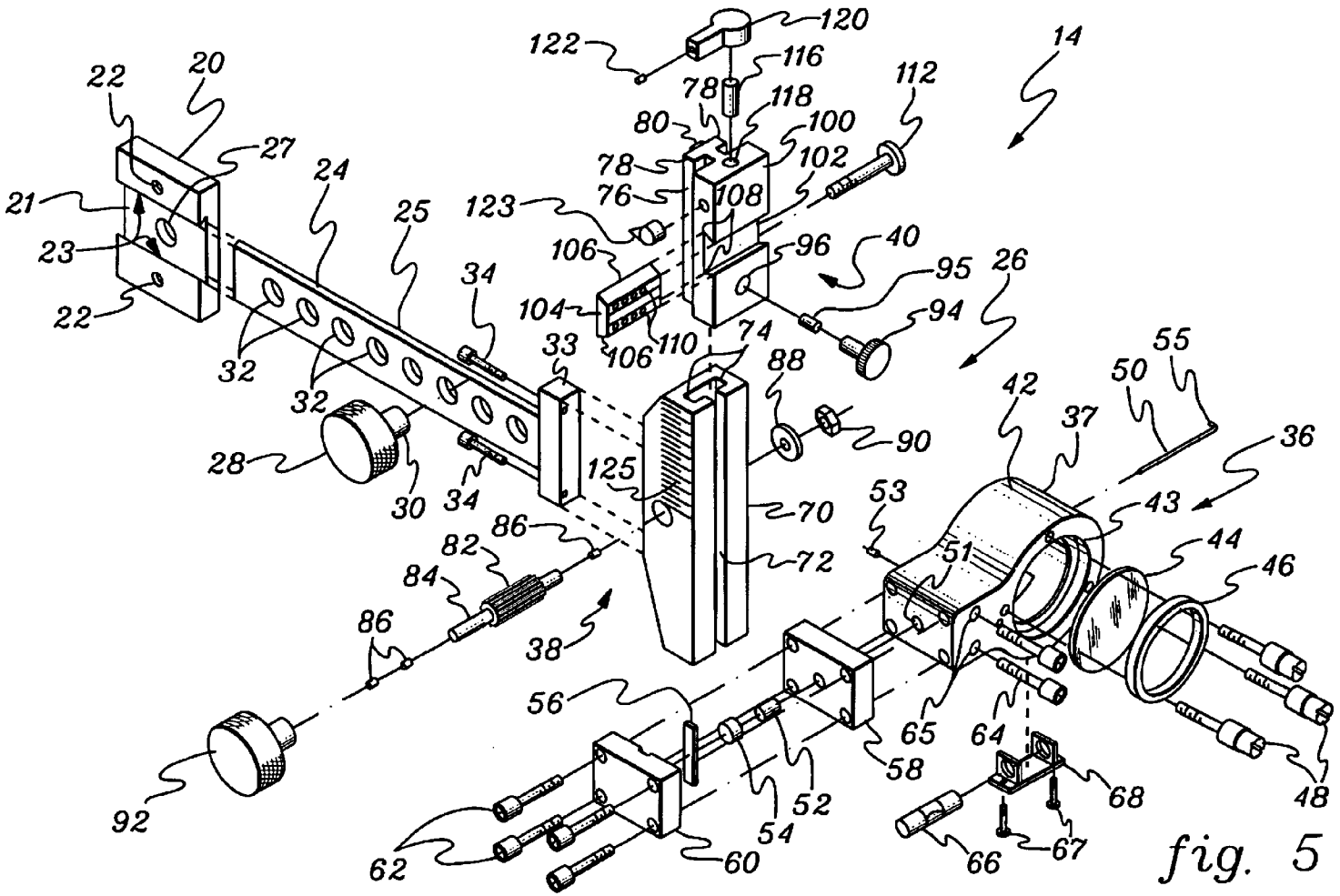
FIG. 5 is an exploded perspective view of the aspect of the invention shown in FIG. 2.

FIG. 2 illustrates a perspective view of sight 14 shown in FIG. 1. FIGS. 3 and 4 illustrate a side elevation view and a front elevation view, respectively, of sight 14 shown in FIG. 2. In addition, FIG. 5 illustrates an exploded perspective view of sight 14 shown in FIG. 2. The sight shown in these figures is marketed under the trademark MAG SIGHT™ by Mag Sight Products, Inc. of Ballston Spa, N.Y.

As mentioned above with respect to FIG. 1, sight 14 includes mounting arrangement 18 for mounting sight 14 to bow 12, a mounting arm 24, and an optic mounting assembly 26. Though many conventional types of mounting arrangements may be used according to the present invention, in the aspect of the invention shown in FIG. 2, mounting arrangement 18 includes a mounting block 20 (which may also be referred to as an "anchor plate") having through holes 22 for attaching mounting block 20 to bow 12, for example, to bow handle riser 16 of bow 12. Mounting block 20 may be metallic or non-metallic, but in one aspect of the invention, mounting block 20 may be made from a polymer, for example, a vibration-damping plastic such as Dupont Delrin® acetal, Dupont Nylon™, or their equivalents. Holes 22 may be threaded or non-threaded holes and mounting block 20 m ay be mounted to bow 12 by one or more conventional mechanical fasteners, for example, bolts or screws. As shown most clearly in FIG. 5, mounting block 20 may include a channel 21 for attaching mounting arm 24. Channel 21 may have beveled recesses 23 for accepting beveled edges 25 of mounting arm 24.

Mounting arm 24 (which may also be referred to as a "tee bar") provides a means for attaching optic mounting assembly 26 to mounting block 20, for example, a means for adjustably mounting optic mounting assembly 26 to mounting block 20. Though according to the present invention many different means of attaching mounting arm 24 to mounting block 20 may be used, in one aspect of the invention as shown in FIGS. 2, 3, and 5, mounting arm 24 slidably engages channel 21 in mounting block 20. In one aspect of the invention, mounting arm 24 includes beveled edges 25 which slidably engage beveled recesses 23 in mounting block 20. Mounting arm 24 may be metallic or non-metallic, but in one aspect of the invention, mounting arm 24 may be made from aluminum, magnesium, or low-weight alloyed material.

Optic mounting assembly 26 may be attached to mounting arm 24 by any conventional means, for example, by non-removable means, for example, welding, or removable means, for example, mechanical fasteners. Mounting arm 24 may also be an integral part of optic mounting assembly 26, for example, mounting arm 25 may be integrally cast or forged or machined from a common metal block as the mating part of optic mounting assembly 26. However, in the aspect of the invention shown in FIGS. 2, 3, and 5, mounting arm 25 includes an integral flange 33 and optic mounting assembly 26 is attached to flange 33 by means of threaded fasteners, for example, hex head cap screws, for instance, #8-32 socket-head cap-screws (SHCS) or stainless steel hex head cap screws.

Though according to the invention many means of retaining mounting arm 24 on mounting block 20 may be used, in the aspect of the invention shown in FIGS. 2, 3, and 5, mounting arm 24 is retained in mounting block 20 by means of one or more set screws or knobs 28 having a threaded end 30 which engages one or more through holes 32 in mounting arm 24. Through holes 32 may be threaded or non-threaded. According to one aspect of the invention, threaded end 30 of knob 28 is threaded into a through hole 32 wherein threaded end 30 of knob 28 bears against the surface of channel 21 in mounting block 20. This bearing of threaded end 30 against the surface of channel 21 causes the beveled edges 25 of mounting arm 24 to be compressed against the beveled recesses 23 in channel 21 and as a result retains mounting arm 24 in mounting block 20. In one aspect of the invention, mounting block 20 may include a recess 27, for example, a circular recess. In this aspect of the invention, threaded end 30 of knob 28 may engage recess 27 to ensure a more positive engagement between mounting arm 24 and mounting block 20 and also to provide for repeatable positioning of optic mounting assembly 26 in mounting block 20.

According to one aspect of the invention, optic mounting assembly 26 comprises at least an optic assembly 36, an elevation adjustment mechanism 38, or a windage adjustment mechanism 40. In one aspect of the invention, optic mounting assembly 26 comprises at least one optic assembly 36 and an elevation adjustment mechanism 38 or a windage adjustment mechanism 40. In another aspect of the invention, optic mounting assembly 26 comprises at least one optic assembly 36 and both an elevation adjustment mechanism 38 and a windage adjustment mechanism 40.

According to one aspect of the invention, optic assembly 36 includes a lens holder 37 having a housing 42 with a through hole or aperture 43. In one aspect of the invention, housing 42 is fabricated at least partially from a light-transferring material, for example, a transparent or translucent material, for example, acrylic, urethane, or epoxy. In one aspect of the invention, housing 42 is made entirely from a light-transferring material. Through hole 43 may be covered by a lens 44 and lens 44 may be retained by a retaining ring 46 mounted by a one or more mechanical fasteners 48, for example, screws. In one aspect of the invention, mechanical fasteners 48 may retain retaining ring 46 which retains lens 44 by simple interference. In another aspect of the invention, retaining ring 46 and lens 44 may include through-holes through which fasteners 48 pass to retain lens 44. In one aspect of the invention, retaining ring 46 is provided in a different color than housing 42 which aids in more clearly defining aperture 43 for the archer. Lens 44 may be a plastic or glass lens and may provide at least some magnification. Lens 44 may also include some form of graphic, such as cross-hairs or other aiming-assisting graphic. According to one aspect of the invention, optic assembly 36 includes at least one optical fiber 50 mounted in aperture 43, for example, horizontally (as shown), vertically, or otherwise oriented, in an hole 51 in housing 42. Optical fiber 50 may be a flourescent or scintillating optical fiber, for example, an optical fiber provided by Industrial Fiber Optics, Inc. Optical fiber 50 typically includes a curved end 55 for directing light toward the eye of the archer to provide an illuminated sighting reference for the archer. Optical fiber 50 may be retained in hole 51 by any conventional means including mechanical fasteners or adhesives. In the aspect of the invention shown in FIG. 5, optical fiber is retained in hole 51 by means of set screw 53. Optical fiber 50 may be colored fluorescent optical fiber. Optical fiber 50 may typically have a diameter of between about 0.010 inches and about 0.050 inches, for example, about 0.030 inches.

A source of light for illuminating optic fiber 50 may be provided by any artificial light source or by ambient light transmitted through light-transmitting housing 42. In one aspect of the invention, a source of light may be provided by one or more artificial light sources 52, such as one or more light-emitting-diodes, though other types of light sources, such as an incandescent lights or Calume™-type light sources may be used. In another aspect of the invention, no artificial light source is used and optic fiber 50 is illuminated by ambient light transmitted through light-transferring housing 42 alone. In another aspect of the invention, optic fiber 50 may be illuminated by at least some light from an artificial light source and at least some ambient light transmitted through light-transferring housing 42. In one aspect of the invention, artificial light source 52 is powered by one or more batteries 54. The power provided by one or more batteries 54 may be manually or remotely controlled, for example, by means of manual switch 56. In one aspect of the invention, artificial light source 52, battery 54, and manual switch 56 are retained in a housing comprising a housing main body 58 and a housing cover 60. Housing main body 58 and a housing cover 60 may mounted to housing 42 by means of one or more mechanical fasteners 62, for example, a plurality of hex head cap screws, for instance, a plurality of #4-40 SHCS stainless steel hex head cap screws.

According to one aspect of the invention, optical assembly 36 is mounted to elevation adjustment mechanism 38 or a windage adjustment mechanism 40 by one or more mechanical fasteners 64, for example, by means of a plurality of hex head cap screws, for instance, #8-32 SHCS stainless steel hex head cap screws. Mechanical fasteners 64 may be loosely fit into holes 65 in housing 42 to accommodate leveling of the lens holder 37 with respect to the bow string, for example, holes 65 may be sufficiently larger than fasteners 64 wherein, after loosening of fasteners 64, housing 42 of lens holder 37 may be manipulated (for example, manually manipulated) to level housing lens holder 37 with respect to the string of the bow (for example, the string of bow 12 shown in FIG. 1).

Optical assembly 36 may also include a level vial 66 mounted in a level vial mount 68 which may be inserted into housing 42 of lens holder 37 by means of mechanical fasteners, for example, in a cavity at the base of hole 43. Level vial mount 68 may be mounted by one or more mounting screws 67. The clearance between the mounting holes in level vial mount 68 and mounting screws 67 may be sufficient to allow for adjustment of the orientation of level vial mount 68 relative to housing 42. According to one aspect of the invention, the mounting of level vial mount 68 facilitates third-axis leveling of sight 14. The leveling of sight 14, including third axis leveling, is discussed below.

According to one aspect of the invention, optic mounting assembly 26 includes at least one elevation adjustment mechanism 38. According to one aspect of the invention, elevation adjustment mechanism 38, includes a main body 70, for example, an elongated main body 70 having an elongated channel 72. Main body 70 may be metallic or non-metallic, for example, in one aspect of the invention, main body 70 is made from steel, aluminum, magnesium, titanium, or an alloy having similar properties to these metals. In the aspect of the invention shown in FIG. 5, channel 72 includes lateral extensions 74 wherein channel 72 is t-shaped in cross section, though other channel cross-sectional shapes may be used. In the aspect of the invention shown in FIG. 5, elevation adjustment mechanism 38 includes a slider 76 adapted to be inserted into channel 72 and slide or translate within channel 72. Slider 76 may be metallic or non-metallic, for example, in one aspect of the invention, slider 76 is made from an acetal plastic, such as Dupont Delrin acetal plastic, or its equivalent. In the aspect of the invention shown in FIG. 5, slider 76 includes lateral extensions 78 which cooperate with lateral extensions 74 in channel 72, though other slider cross-sectional shapes may be used. According to one aspect of the present invention, slider 76 may be physically coupled to optic assembly 36, for example, by means of mechanical fasteners. However, in the aspect of the invention shown in FIG. 5, slider 76 is an integral part of housing 100 of windage adjustment assembly 40, which is discussed below.

In one aspect of the invention, the movement of slider 76 within channel 72 may be controlled or varied by any conventional manual or automatic means. According to the aspect of the present invention illustrated in FIG. 5, the vertical position of slider 76 of elevation adjustment mechanism 38 is varied by means of a rack and pinion drive mechanism. According to this aspect of the invention, elevation adjustment mechanism 38 includes a rack 80 and a pinion 82 mounted for rotation in housing 70 by means of shaft 84. Pinion 82 engages rack 80 on slider 76. Shaft 84 may be mounted in housing 70 with the aid of one or more spacers, for example, cylindrical spacers 86 made from Dupont Nylon or Dupont Delrin acetal, or an equivalent plastic, and disk-like spacers 88 made from Dupont Nylon or Dupont Delrin acetal, or an equivalent plastic. Shaft 84 may include a threaded end and be retained in housing 70 may means of one or more nuts 90.

Again, though according to the present invention, any manual or automated means may be used to rotate pinion 82 to effect translation of slider 76 via rack 80, in the aspect of the invention shown in FIG. 5, slider 76 is translated via manual rotation of knob 92 which is attached to shaft 84 by conventional means. When adjusted as desired, the position of slider 76 (and the position of optic assembly 36 to which slider 76 is attached) may be retained by means of one or more set screws 94. Set screw 94 (for example, manual set screw 94) is inserted into through hole 96 in slider 76 (or housing 100), for example, threaded hole 96, and bears against housing 70, for example, bears against channel 72 in housing 70, to retain slider 76 in its desired position. A resilient spacer or "slug" 95 may be inserted into hole 96 to provide a resilient contact between set screw 94 and,for example, housing 70. Spacer 95 may be made from a plastic material, for example, Dupont Nylon or Dupont Delrin acetal, or an equivalent plastic. According to one aspect of the invention, the rack and pinion elevation adjustment mechanism 38 provides for very fine elevation adjustment of an optic, for example, for optic assembly 36.

In one aspect of the invention main body 70 may include means for attaching mounting arm 24 to the optic mounting assembly 26, for example, a plurality of threaded holes (not shown) for receiving screws 34, though other mounting means may be used. Main body 70 may include a plurality of paired threaded holes at different locations to allow for adjustable mounting of elevation adjustment mechanism 38 or optic mounting assembly 26 to mounting arm 24.

According to one aspect of the invention, optic mounting assembly 26 includes at least one windage adjustment mechanism 40. According to one aspect of the invention, windage adjustment mechanism 40, includes a main body 100 having a channel 102 and a windage slider 104 (for example, a windage dovetail) which slidably engages channel 102. Main body 100 may be metallic or non-metallic, for example, in one aspect of the invention, main body 100 is made from Dupont Nylon or Dupont Delrin acetal, or an equivalent plastic. Windage slider 104 may be metallic or non-metallic, for example, in one aspect of the invention, windage slider 104 is made from aluminum or magnesium.

In the aspect of the invention shown in FIG. 5, windage slider 104 engages channel 102 by means of dovetailed projections 106 on slider 104 and dovetailed recesses 108 in channel 102, though other shapes of cooperating projections and recesses may be used according to the present invention. According to one aspect of the present invention, windage slider 104 may be physically coupled to optic assembly 36, for example, by means of mechanical fasteners. In the aspect of the invention shown in FIG. 5, for example, windage slider 104 includes threaded holes 110 which accept screws 64 for mounting optic assembly 36.

Figure 6:
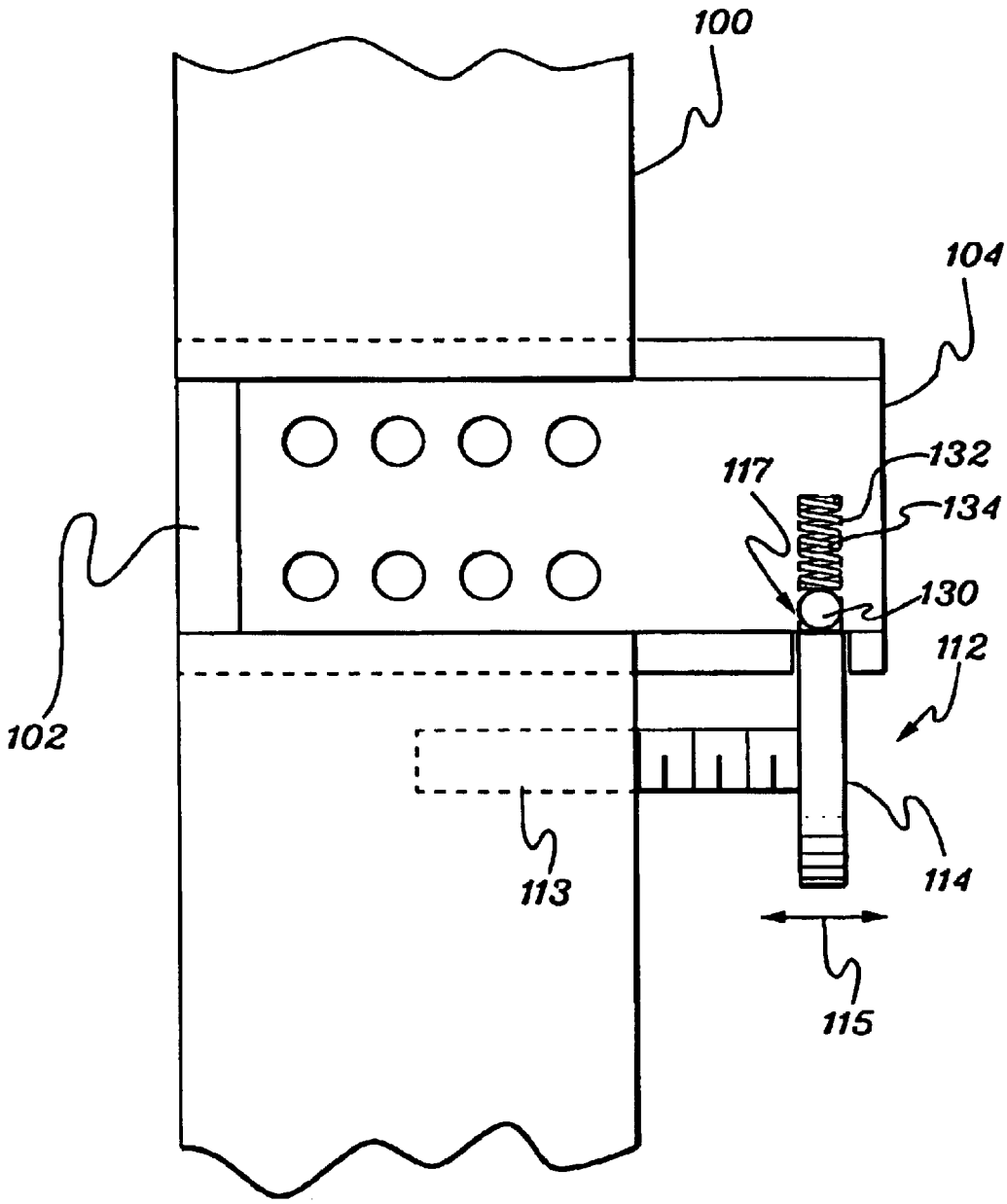
FIG. 6 illustrates a detailed view of the windage adjustment mechanism according to one aspect of the invention.

In one aspect of the invention, the movement of windage slider 104 within channel 102 may be controlled or varied by any conventional manual or automatic means. According to the aspect of the present invention illustrated in FIG. 5, the horizontal position of windage slider 104 of windage adjustment mechanism 40 is varied by means adjustment screw 112 having a projection or disk-like crown 114. In one aspect of the invention adjustment screw 112 engages a threaded hole 113 (see FIG. 6) in main body 100. As shown more clearly in FIG. 6, according to one aspect of the invention, crown 114 of adjustment screw 112 may engage a notch 117 in windage slider 104 whereby the rotation of screw 112 and the corresponding translation of crown 114 laterally deflects windage slider 104 in channel 102 as indicted by double arrow 115. According to one aspect of the invention, disk-like crown 114 may include a notches on its outer diameter, for example, a series of evenly distributed indentations, that function as detents during the rotation of screw 112. The detents may include a spring-loaded ball or spacer 130 that deflects as the indentations engage and disengage the spring-loaded ball 130 spring-loaded ball or spacer 130 may be mounted in a blind hole 132 (shown in phantom) in windage slider 104 along with spring 134. These detents may provide an audible sound (for example, a "click") when engaged with notch 117 of windage slider 104 to aid the archer during windage adjustment. The position of windage slider 104 can be fixed by means of set screw 116 (see FIG. 5) threaded into a hole 118 in main body 100. The rotation of set screw 116 may be facilitated by a knob 120 attached to set screw 116 by means of set screw 122. A resilient spacer or "slug" (not shown) may be inserted into hole 118 to provide a resilient contact between set screw 116 and windage slider 104. The spacer inserted in hole 118 may be from a plastic material, for example, Dupont Nylon or Dupont Delrin acetal, or an equivalent plastic. According to one aspect of the invention, windage adjustment mechanism 40 provides for very fine windage adjustment of an optic, for example, for optic assembly 36.

In one aspect of the invention main 100 may include a pointer 123 rigidly mounted to slider 76 (or to main body 100), and main body 70 of elevation adjustment mechanism 38 may include a graduated scale 125, for example, with readable indicia, for instance, numbers or letters. Pointer 123 and scale 125 can be used to identify the elevation setting which can be recorded or marked on scale 125 for future reference.

In another aspect of the invention, windage adjustment mechanism 40 may be physically coupled to elevation adjustment mechanism 38, for example, by means of welding or mechanical fasteners. However, in the aspect of the invention shown in FIG. 5, windage adjustment housing 100 is attached to or integrated with elevation slider 76. For example, in one aspect of the invention, housing 100 and slider 76 comprise a single integral component, for example, a component made from, for example, Dupont Nylon or Dupont Delrin acetal, or an equivalent plastic.

According to one aspect of the invention, a method for leveling an archery bow and sight is provided which facilitates the leveling of the archery bow and improves the maintenance of the leveling of the archery bow. For example, in one aspect of the invention, a method is provided which facilitates third-axis leveling of the sight and more readily maintains third-axis leveling of the sight, for example, even when the bow or sight are subjected to agitation or mishandling. According to this aspect of the invention, the bow, for example, bow 12 in FIG. 1, having a sight 14 is first mounted in an substantially vertical position, that is, a first position, for example, in a conventional bow vise or clamp. The orientation of the bow is then adjusted, for example, using a conventional level, such as a 4-foot construction level, so that the bow string becomes substantially plumb with the ground, that is, bow 12 is in a second position. The orientation the sight 14 is next adjusted so that the horizontal axis of sight 14 is brought to a position substantially perpendicular to the bow string of bow 12. This adjustment of sight 14 with the bow string typically comprises leveling lens housing 37 in sight 14 wherein vial level 66 is substantially horizontal as indicated by the centering of the bubble in vial level 66. According to one aspect of the invention, the adjustment of the position of housing 37 may be facilitated by loosening one or more mounting screws 64. In one aspect of the invention, the clearance between screws 64 and holes 65 permit the movement and adjustment of lens housing 37 whereby lens housing 37 can be leveled relative to the bow string. Screws 64 may then be tightened to maintain the desired orientation of lens housing 37.

According to one aspect of the present invention, the leveling procedure continues by adjusting the orientation of vial level 66 relative to housing 37 to ensure that the scope and bow remain in proper registration regardless of the angular orientation of the bow, for example, regardless of whether the archer is shooting up hill, down hill, or on level ground—that is, third-axis leveling. According to this aspect of the invention, the orientation of the bow and sight assembly is varied wherein the bow is rotated about its horizontal axis wherein the sight is directed in a non-horizontal direction, for example, canted upward or canted downward at least about 5 degrees, typically at least about 15 degrees—to a third position. This rotation of the bow is effected while maintaining the bow string in an substantially plumb position. Such a rotation of the bow and sight assembly typically induce a misalignment of the vial level 66 in lens housing 37 which is manifest as a deflection of the bubble from the center of vial level 66. According to this aspect of the invention, third-axis leveling can be achieved, while the bow is in the third position, by adjusting the orientation of in the vial level mount 68 relative to lens housing 37 wherein the bubble in vial level 66 is returned to substantially the center of vial level 66. According to one aspect of the invention, the orientation of vial level mount 68 with respect to lens housing 37 may be varied by first loosening level mounting screws 67 and then adjusting the orientation of vial level mount 68 in lens housing 37. The orientation of vial level mount 68 may be comprise manually adjusting the orientation of vial level mount 68 or by using a tool, such as a screw driver, for example, prying the level mount 68 into the desired level orientation. According to one aspect of the invention, the adjustment of the orientation of vial level mount 68 relative to lens housing 37 may be effected by simply rotating one or more mounting screws 67. After adjustment, the orientation of vial level mount 68 may be fixed by tightening one or more screws 67, or tightening one or more lock nuts on one or more screws 67. After adjusting the orientation of level mount 68 to a level position in lens housing 37—while the bow is oriented in the canted, third position—the bow and sight assembly will then be leveled or registered for use in any orientation by the archer. According to this aspect of the invention, adjustment methods and adjustment apparatus are provided which facilitate the leveling of archery bows and scopes and improve the maintenance of the leveling of archery bows and scopes.

The present invention as described above and in the attached claims provides a sight that overcomes many of the limitations of prior art sights. Aspects of the present provide for ease of gross and fine adjustment and fixing of both elevation and windage, illumination of an optic fiber via a light-transferring housing, an artificial light, or a combination thereof, and a light yet durable construction. Though the many aspects of the present invention can be applied to sights used for archery, for example, for longbows, compound bows, and recurve bows, and the like, many aspects of the invention can also be applied to other sighting applications, for example, for riffles, handguns, and other firearms.

While the invention has been particularly shown and described with reference to preferred embodiment, it will be understood by those skilled in the art that various changes in form and details may be made to the invention without departing from the spirit and scope of the invention described in the following claims.

What is claimed is:

1. An optic assembly for use in an archery sight, the optic assembly comprising:

a lens holder comprising:

a housing at least partially made from a light-transferring material;

an aperture in the housing;

means for mounting a lens in the aperture; and means for mounting the housing to the sight; and at least one fiber-optic pin positioned in the lens holder; wherein the housing made from the light-transferring material provides at least some illumination to the fiber-optic pin.

2. The optic assembly as recited in claim 1, wherein the housing at least partially made from the light-transferring material provides substantially all the illumination for the at least one fiber-optic pin.

3. The optic assembly as recited in claim 1 wherein the at least one fiber-optic pin comprises a fiber-optic pin mounted in the aperture of the lens holder.

4. The optic assembly as recited in claim 3, wherein the at least one fiber-optic pin comprises a plurality of fiber-optic pins.

5. The optic assembly as recited in claim 2 wherein the light-gathering material comprises a polymer material.

6. The optic assembly as recited in claim 1, further comprising an artificial light source for illuminating the at least one fiber-optic pin.

7. The optic assembly as recited in claim 6, wherein the artificial light source comprises a light-emitting diode.

8. The optic assembly as recited in claim 6, further comprising a source of electric power for the artificial light source and a switch for directing the electric power to the artificial light source.

9. The optic assembly as recited in claim 1, wherein the means for mounting a lens in the aperture comprises a retaining ring comprising a material of a different color than the housing.

10. The optic assembly as recited in claim 5, wherein the polymer material comprises an acrylic material.

11. An elevation adjustment mechanism for an archery bow sight having an optic, the adjustment mechanism comprising:

an elongated main body adapted for mounting to a bow, the main body having a channel elongated in the direction of elongation of the main body;

a slider adapted for mounting to the optic and the slider slidably engageable with the channel of the main body and having a rack thereon; and a shaft mounted for rotation in the main body and having a pinion engageable with the rack of the slider;

wherein rotating the pinion moves the rack of the slider to provide elevation adjustment of the optic.

12. The elevation adjustment mechanism as recited in claim 11, further comprising a knob adapted for mounting on the shaft.

13. The elevation adjustment mechanism as recited in claim 11, further comprising means for retaining the elevation setting of the optic at the desired elevation.

14. The elevation adjustment mechanism as recited in claim 13, wherein the means for retaining the elevation of the optic comprises at least one set screw mounted in the main body.

15. The elevation adjustment mechanism as recited in claim 11, wherein the main body comprises a light-weight material.

16. The elevation adjustment mechanism as recited in claim 15, wherein the light-weight material comprises magnesium.

17. The elevation adjustment mechanism as recited in claim 11, wherein the channel in the main body comprises a channel having at least one lateral recess and wherein the slider comprises at least one lateral projection slidably engageable with the at least one lateral recess of the main body.

18. The elevation adjustment mechanism as recited in claim 11, further comprising a scale mounted on the main body and a pointer mounted on the slider.

19. The elevation adjustment mechanism as recited in claim 11, wherein the slider comprises a light-weight material.

20. The elevation adjustment mechanism as recited in claim 19, wherein the light-weight material comprises aluminum, magnesium, or titanium.

21. A windage adjustment mechanism for an archery bow sight having an optic, the adjustment mechanism comprising:

a main body adapted for mounting to a bow and having a channel;

a windage bar slidably mounted in the channel and adapted for mounting the optic to the windage bar; and means for translating the windage bar in the channel wherein windage adjustment of the optic is provided;

wherein the windage bar further comprises a recess and wherein the means for translating the windage bar comprises a threaded rod having a projection which engages the recess in the windage bar.

22. The windage adjustment mechanism as recited in claim 21 wherein the projection comprises a disk integrally mounted to the threaded bar.

23. The windage adjustment mechanism as recited in claim 22, wherein the disk comprises a rim having a plurality of notches.

24. The windage adjustment mechanism as recited in claim 23 wherein the windage adjustment mechanism includes a spring-loaded ball, and wherein the plurality of notches engage the windage bar wherein an audible sound is emitted from the spring-loaded ball when the disk is rotated.

25. The windage adjustment mechanism as recited in claim 21, wherein the slidable mounting of the windage bar in the channel of the main body comprises a dovetailed slidable mounting.

26. The windage adjustment mechanism as recited in claim 21, further comprising means for retaining the windage setting of the optic at the desired windage.

27. The windage adjustment mechanism as recited in claim 26, wherein the means for retaining the windage setting of the optic comprises at least one spacer and at least one set screw which compresses the spacer against the windage bar.

28. The windage adjustment mechanism as recited in claim 21, wherein the main body comprises a light-weight material.

29. The windage adjustment mechanism as recited in claim 28 wherein the light-weight material comprises magnesium, aluminum, or titanium.

30. An elevation and windage adjustment mechanism for an archery bow sight having an optic, the adjustment mechanism comprising:

an elongated main body adapted for mounting to a bow, the main body having a first channel elongated in the direction of elongation of the main body;

a slider slidably engageable with the first channel of the main body, the slider having a rack thereon and a second channel elongated in a direction perpendicular to direction of elongation of the main body;

a windage bar slidably mounted in the second channel of the slider and adapted for mounting the optic to the windage bar;

a shaft mounted for rotation in the main body and having a pinion engageable with the rack of the slider mount;

means for rotating the shaft wherein the pinion engages the rack of the slider wherein elevation adjustment of the optic is provided; and means for translating the windage bar in the second channel wherein windage adjustment of the optic is provided, wherein the windage bar further comprises a recess and wherein the means for translating the windage bar comprises a threaded rod having a projection which engages the recess in the windage bar.

31. The elevation and windage adjustment mechanism as recited in claim 30, wherein the means for rotating the shaft comprises a knob adapted for mounting on the shaft.

32. The elevation and windage adjustment mechanism as recited in claim 30, wherein the projection comprises a disk integrally mounted to the threaded bar.

33. The elevation and windage adjustment mechanism as recited in claim 30, wherein the first channel in the main body comprises a channel having at least one lateral recess and wherein the slider comprises at least one lateral projection slidably engageable with the at least one lateral recess of the first channel of the main body.

34. The elevation and windage adjustment mechanism as recited in claim 30, wherein the slidable mounting of the windage bar in the channel of the main body comprises a dovetailed slidable mounting.

35. The elevation and windage adjustment mechanism as recited in claim 30, wherein the main body is fabricated from magnesium.

36. The elevation and windage adjustment mechanism as recited in claim 30, wherein the slider comprises an acetal plastic.

37. The elevation and windage adjustment mechanism as recited in claim 30, wherein the bow comprises a vertical axis and wherein the direction of elongation of the main body is parallel to the vertical axis of the bow.

38. The elevation and windage adjustment mechanism as recited in claim 30, further comprising means for retaining the windage setting of the optic at the desired windage and means for retaining the elevation setting of the optic at the desired elevation.

39. An archery sight comprising:

an optic assembly, the optic assembly comprising:

a lens holder comprising:

a housing made from a light-transferring material;

an aperture in the housing;

means for mounting a reticle in the aperture; and means for mounting the housing to the sight; and at least one fiber-optic pin positioned in the lens holder;

wherein the housing made from the light-transferring material provides at least some illumination to the fiber-optic pin;

an elevation adjustment mechanism comprising:

an elongated main body adapted for mounting to a bow, the main body having a first channel elongated in the direction of elongation of the main body;

a slider adapted for mounting to the optic assembly and slidably engageable with the first channel of the main body and having a rack thereon;

a shaft mounted for rotation in the main body and having a pinion engageable with the rack of the slider; and means for rotating the shaft wherein the pinion engages the rack of the slider wherein elevation adjustment of the optic assembly is provided; and a windage adjustment mechanism comprising:

a second channel in the slider of the elevation adjustment mechanism;

a windage bar slidably mounted in the second channel and adapted for mounting to the optic assembly; and means for translating the windage bar in the second channel wherein windage adjustment of the optic assembly is provided.

40. The archery sight as recited in claim 39, further comprising a third-axis leveling mechanism.

41. The archery sight as recited in claim 40, wherein the third-axis leveling mechanism comprises:

a leveling vial mount adjustably mounted to the lens holder;

a leveling vial mounted in the leveling vial mount;

means for adjusting the position of the leveling vial mount to provide third-axis leveling of the archery sight.

42. The archery sight as recited in claim 41, wherein the means for adjusting the position of the leveling vial mount comprises at least one adjustment screw.

43. A third-axis leveling mechanism for an archery bow sight having an optic, the third-axis leveling mechanism comprising:

a leveling vial mount adjustably mounted to the optic;

a leveling vial mounted in the leveling vial mount;

means for adjusting the position of the leveling vial mount to provide third-axis leveling of the archery bow.

44. The third-axis leveling mechanism as recited in claim 43, wherein the mean for adjusting the position of the leveling vial mount comprises at least one adjustment screw.

* * * * *

UNITED STATES PATENT AND TRADEMARK OFFICE

CERTIFICATE OF CORRECTION

PATENT NO. : 6,802,129 B1
DATED : October 12, 2004
INVENTOR(S) : Wirth

It is certified that error appears in the above-identified patent and that said Letters Patent is hereby corrected as shown below:

Title page,
Item [76], Inventor, delete “Balston” and isnert -- Ballston --
Item [57], ABSTRACT,
Line 15, delete the word “house.” and insert --housing. --

Column 8,
Line 32, insert a -- . -- after the number “130” in the first instance
Line 32, delete “spring-loaded” and insert -- Spring-loaded --

Column 13,
Line 15, delete the word “reticle” and insert -- reticule --

Signed and Sealed this

Twenty-fourth Day of May, 2005

JON W. DUDAS
*Director of the United States Patent and Trademark Office*